US006932265B2

(12) United States Patent
Sax et al.

(10) Patent No.: US 6,932,265 B2
(45) Date of Patent: Aug. 23, 2005

(54) BOX CONVERTIBLE TO A DISPLAY CONTAINER AND METHOD OF MAKING SAME

(75) Inventors: Alan Sax, Chicago, IL (US); Andre C. Smith, Chicago, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 16 days.

(21) Appl. No.: 10/393,140

(22) Filed: Mar. 20, 2003

(65) Prior Publication Data

US 2004/0074956 A1 Apr. 22, 2004

Related U.S. Application Data

(63) Continuation-in-part of application No. 29/169,290, filed on Oct. 17, 2002, now Pat. No. Des. 503,614.

(51) Int. Cl.[7] ..... B65D 17/32; B65D 17/347

(52) U.S. Cl. ..... 229/122; 206/736; 206/773; 229/160.2; 229/238; 229/242

(58) Field of Search ..... 229/122, 206, 229/238, 240, 242, 160.2; 206/736, 766, 772, 773, 774

(56) References Cited

U.S. PATENT DOCUMENTS

| | | | | |
|---|---|---|---|---|
| 1,620,197 | A | 3/1927 | Evans | |
| 1,639,750 | A | 8/1927 | Portman | |
| 1,986,101 | A | 1/1935 | Brodsky | |
| 2,005,924 | A | 6/1935 | Wilson | |
| 2,031,111 | A | 2/1936 | Kondolf | |
| 2,135,041 | A | 11/1938 | Myers | |
| 2,241,710 | A | 5/1941 | Lowey | |
| 2,252,147 | A | 8/1941 | Warren | |
| 2,252,779 | A | 8/1941 | Moore | |
| 2,321,473 | A | 6/1943 | Ferguson | |
| 2,407,781 | A | 9/1946 | Guyer | |
| 2,435,135 | A | 1/1948 | Franck | |
| 2,456,168 | A | 12/1948 | Behrens | |
| 2,593,333 | A | 4/1952 | Myers | 206/45.31 |
| 2,595,202 | A | 4/1952 | Pardee | |
| 2,624,455 | A | 1/1953 | Myers | 206/45.27 |
| 2,750,096 | A | 6/1956 | Misch | |
| 2,776,083 | A | 1/1957 | Derman | |
| 2,822,972 | A | 2/1958 | Hartley | |
| 2,949,221 | A | 8/1960 | Lugt, Jr. | |
| 2,973,086 | A | 2/1961 | Thompson | 206/45.31 |
| 3,002,608 | A | 10/1961 | Zwickey | 206/45.14 |
| 3,066,843 | A | 12/1962 | Johnson | |

(Continued)

FOREIGN PATENT DOCUMENTS

| | | | |
|---|---|---|---|
| FR | 2663614 | 12/1991 | B65D/71/38 |
| GB | 2245253 | 2/2002 | B65D/25/54 |
| WO | WO 93/01982 | 2/1993 | B65D/5/42 |

OTHER PUBLICATIONS

The Wiley Encyclopedia of Packaging Technology, John Wiley & Sons, pp. 504–506 (1986).*

"Nestle USA" box design (Packaging Corporation of America).

*Primary Examiner*—Gary E. Elkins

(74) *Attorney, Agent, or Firm*—Armstrong Teasdale LLP

(57) ABSTRACT

A container for the shipping and display of goods includes a box formed from a first blank. The box includes a front panel having upper and lower flaps, a first side panel having upper and lower flaps, a second side panel having upper and lower flaps, and a rear panel having upper and lower flaps. A breakaway panel defined by a first line of weakness is formed within a portion of one or more of the aforesaid panels. A breakaway assist panel is formed from a distinct, separate second blank. The breakaway assist panel is adhered to the breakaway panel to facilitate separation of the breakaway panel from the box, by first pulling on the breakaway assist panel to rupture the first line of weakness and then removing the joined breakaway panel and breakaway assist panel.

15 Claims, 4 Drawing Sheets

U.S. PATENT DOCUMENTS 3,135,452 A 6/1964 Brundage
3,206,098 A 9/1965 Stenger et al.
3,207,411 A 9/1965 Farquhar
3,262,631 A 7/1966 Belsinger
3,298,505 A 1/1967 Stephenson ..... 206/45.31
3,305,079 A 2/1967 Bowman et al. ..... 206/45.31
3,309,206 A 3/1967 Daniels
3,343,659 A 9/1967 Marondel ..... 206/45.31
3,346,168 A 10/1967 Rouder
3,348,666 A 10/1967 McCormick
3,349,959 A 10/1967 Watkins ..... 221/48
3,371,773 A 3/1968 Flisch ..... 206/45.31
3,385,430 A 5/1968 Benzon-Petersen
3,409,445 A 11/1968 Hall
3,528,598 A 9/1970 Lock
3,533,546 A 10/1970 Kossnar
3,591,069 A 7/1971 Heller, Jr. et al.
3,635,393 A 1/1972 Herglotz
3,638,848 A 2/1972 Heyworth
3,835,989 A 9/1974 Mori et al. ..... 206/45.31
3,870,221 A 3/1975 Zeitter
3,872,966 A 3/1975 Gordon et al. ..... 206/45.31
3,891,137 A 6/1975 Ellison et al.
3,937,393 A 2/1976 Nerenberg
3,949,868 A 4/1976 Allen ..... 206/45.34
3,961,706 A 6/1976 Roccaforte et al.
3,981,432 A 9/1976 Bergstein et al.
4,009,820 A 3/1977 Fitzgerald
4,121,755 A 10/1978 Meseke et al.
4,210,240 A 7/1980 Fricano ..... 206/45.31
4,382,511 A 5/1983 Hamelin et al. ..... 206/427
4,388,993 A 6/1983 Lavery
4,405,044 A 9/1983 Flower et al. ..... 206/44.12
4,441,614 A 4/1984 Gulliver
4,658,961 A 4/1987 Tamura ..... 206/509
4,706,875 A 11/1987 Blackman
4,782,996 A 11/1988 Spahni, Jr. ..... 229/125.09
4,801,080 A 1/1989 Spengler ..... 229/125.19
4,809,847 A 3/1989 Schneider ..... 206/45.31
4,865,187 A 9/1989 Zulauf et al. ..... 206/45.31
4,874,125 A 10/1989 Bates
4,913,339 A 4/1990 Elder ..... 229/120.14
4,925,087 A 5/1990 Ostrander ..... 229/120.03
4,925,088 A 5/1990 Ostrander ..... 229/120.12
4,944,408 A * 7/1990 Rausing ..... 229/242
5,002,222 A * 3/1991 Giblin ..... 229/122
5,054,644 A 10/1991 Greenslade
5,060,853 A 10/1991 Gulliver et al.
5,076,439 A 12/1991 Kuchenbecker ..... 229/207
5,108,030 A 4/1992 Schuster et al.
5,156,276 A 10/1992 Lebowitz ..... 206/588
5,226,532 A * 7/1993 Davidson et al. ..... 229/242
5,320,215 A 6/1994 Brennan ..... 206/44.12
5,333,735 A * 8/1994 Focke et al. ..... 229/160.2
5,350,111 A 9/1994 Vosbikian
5,398,869 A 3/1995 Dickson et al.
5,413,274 A 5/1995 Forbes, Jr.
5,480,090 A 1/1996 Taddei et al.
5,505,371 A 4/1996 O'Neill ..... 229/120.26
5,505,372 A 4/1996 Edson et al. ..... 229/121
5,507,430 A 4/1996 Imhoff ..... 229/125.19
5,516,038 A 5/1996 Zaccarini
5,524,750 A 6/1996 Miller ..... 206/767
5,555,982 A 9/1996 Kuhn et al. ..... 206/746
5,556,026 A * 9/1996 Blankitny ..... 229/206
5,595,304 A 1/1997 Timmins ..... 206/598
5,657,872 A 8/1997 Leftwich et al. ..... 206/738
5,664,684 A 9/1997 Evert ..... 206/769
5,842,576 A 12/1998 Snow ..... 206/736
5,881,884 A 3/1999 Podosek ..... 206/774
5,934,551 A 8/1999 Kaufman
5,950,914 A 9/1999 Dunton et al. ..... 229/122
5,957,294 A * 9/1999 Kanter ..... 206/774
6,135,288 A 10/2000 Kim ..... 206/738
6,168,027 B1 1/2001 Esser ..... 206/738
6,371,365 B1 * 4/2002 Doucette et al. ..... 229/240
6,371,366 B1 4/2002 Edgerton et al.
2001/0001447 A1 5/2001 Gregory ..... 206/746
2002/0043554 A1 4/2002 White et al. ..... 229/235
2002/0070145 A1 6/2002 Yuhas et al. ..... 206/746
2003/0226783 A1 12/2003 Jackson et al. ..... 206/772

* cited by examiner

BOX CONVERTIBLE TO A DISPLAY CONTAINER AND METHOD OF MAKING SAME

CROSS-REFERENCE TO RELATED APPLICATIONS

The present application is a continuation-in-part application of U.S. Design patent application Ser. No. 29/169,290, filed on Oct. 17, 2002 Now U.S. Pat. No. D503,614.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE DISCLOSURE

1. Field of the Invention

The present invention is directed to corrugated boxes for shipping goods and, more specifically, to a corrugated regular slotted carton (RSC) shipping box which is readily convertible to a container for displaying the goods shipped therewithin, as well as to a method of making the same.

2. Background Art

Regular slotted carton ("RSC") boxes have been known in the art of shipping containers for many years. The RSC box is a highly economical shipping container, due to the fact that there is very little manufacturing waste. Furthermore, due to its rectangular shape, the RSC box is well suited to shipping goods via cargo container, truck, train, or any other means of transport in which efficient use of space is a priority. As a result, RSC boxes are widely used for shipping and storing many different types of goods.

The RSC box is formed from a single rectangular blank, typically of corrugated paperboard, and comprises four rectangular side panels, each having associated upper and lower flaps, along with a smaller overlap panel adjacent to one of the side panels. In order to articulate such a carton from a rectangular blank, first four crush folds are made parallel to the depth of the box, to define the four side panels. Next, two crush folds are made parallel to the length of the box, located at a distance equal to half the width of the box, to define the upper and lower flaps. Then, slots are cut out between each of the adjacent upper and lower flaps, in order to permit the flaps to be folded inward to form the top and bottom of the box. Next, the box is articulated by folding along the crush folds, so that the side panels are disposed at right angles to one another and the overlap panel overlaps a portion of the non-adjacent side panel. A suitable adhesive is used to adhere the overlap panel to the non-adjacent side panel. Finally, the top and bottom flaps are folded inward, first the flaps associated with the shorter sides of the box, followed by the flaps associated with the longer side, thereby forming top and bottom sides. The flaps are then joined by any desired means, such as tape, adhesive, staples, etc., to close the top and bottom of the box. Typically, the bottom side is closed first, the desired goods are then inserted into the box, and the top side is then closed as well. However, the box may instead be articulated around the goods themselves, in which case both the top and bottom can be closed simultaneously.

One significant disadvantage of the RSC box, however, is the fact that such boxes are not well suited for use as display containers in a retail environment. This is due to the fact that the goods within opened RSC boxes are not visible, other than from the top, unless a portion of one or more side panels is first separated from the box, by means of cutting or tearing. Not only does this require additional effort on the part of the retailer, it also tends to result in an unattractive display container having rough, uneven edges, which can be unsightly in the retail environment.

As a result, goods shipped in an RSC box are typically removed from the box upon arrival at the vending location and placed on shelves or into other containers for display, with the box then simply being discarded. This results in both a significant expenditure of time on the part of the retailer in transferring the goods from the shipping boxes to the display environment, as well as added expense in the form of shelving or display bins for such goods.

A further disadvantage of the RSC box is that the corrugated materials typically used in forming such containers are not well-adapted for displaying high-impact graphics thereon. As a result, when such containers are used to store and display goods in a retail environment, for example in warehouse stores where shipping containers are often placed directly on the sales floor, the potential of providing high-impact sales copy or advertising on such containers is simply not feasible.

A number of prior art containers have addressed the issue of conversion from a shipping container to a display container, for example, those containers disclosed by Imhoff, U.S. Pat. No. 5,507,430; Kuhn et al., U.S. Pat. No. 5,555,982; and Leftwich et al., U.S. Pat. No. 5,657,872. However, none of these prior art containers disclose the use of a standard RSC box which is easily and readily converted to a display container. Rather, these prior art containers all require a plurality of blanks having specialized structures, which are not readily adapted for other uses apart from the disclosed inventions. Accordingly, companies currently producing RSC boxes would be required to incur additional tooling and machine costs to begin producing such containers. Moreover, none of these containers address the issue of providing for high-impact graphics in association with a conventional RSC box formed from corrugated paperboard.

One container that has attempted to address some of these disadvantages is currently distributed by the Packaging Corporation of America. This container is formed from a blank similar to that of a standard RSC box, but having an additional, integral fifth panel, which panel includes upper, middle and lower portions. The fifth panel is adapted such that, when the box is articulated, the lower portion overlaps the front panel, and the middle and upper portions overlap the front panel top flap. The fifth panel further includes a zipper-type separation member separating the middle and upper portions, which, along with a perforation defining the edge between the fifth panel and the adjacent side panel, permits separation and removal of the lower and middle portions of the fifth panel from the remainder of the box. Additionally, a small breakaway panel is formed by a line of weakness within a portion of the front panel of the box, while an adjacent portion of the front panel and front panel upper flap are completely cut out of the container blank prior to assembly to form an aperture.

Upon articulation of the box, the four side panels are joined together in the manner of a conventional RSC box, while the fifth panel is overlaid the front panel and front panel upper flap, with the portion of the fifth panel overlying the breakaway panel being adhered thereto by means of a suitable adhesive. Additionally, the upper portion of the fifth panel is adhered to the portion of the front panel upper flap lying directly therebeneath. The user may convert the box to a display container by (a) pulling upwardly on the separation member to separate the lower and middle portions of the fifth panel from the upper portion, and then (b) pulling outwardly on the lower portion of the fifth panel to separate the perforation joining the fifth panel to the box itself, thereby separating the attached breakaway panel from the front panel of the box. This exposes the aperture located within the box front panel and associated upper flap, thereby permitting access to the goods contained within the box, without the unsightly rough edges typically associated with cutting or tearing away a portion of a conventional RSC box.

However, there are also certain disadvantages associated with the Packaging Corporation of America box. First, the box requires a special blank having five side panels, rather than the standard four-panel blank associated with a conventional RSC box, thus resulting in added tooling and manufacture costs associated with producing such a non-standard blank. Moreover, the fact that a portion of the front panel and associated upper flap are cut out of the blank prior to articulation means that the fifth panel must serve the additional purpose of forming a structural portion of the box itself. As a result of these limitations, the manufacturer of such a box is required to use the same material for both the RSC box itself and the associated fifth panel.

Accordingly, it would be desirable to provide a conventional RSC shipping container which, upon reaching its destination, can quickly and easily be converted into an attractive display container for the goods contained therein, without unsightly rough edges. It would further be desirable to provide such a box which can be converted to a display container without the need to manually cut away a portion of the box side panels. Such a container would allow the vendor to use the shipping container as an attractive display container, with a minimal amount of effort needed to transform the container for display.

It would also be desirable to provide an RSC shipping container constructed from standard corrugated materials, but also having an additional element formed from a separate blank of a material suitable for displaying high-impact graphics. This would allow for the use of unopened shipping containers for displaying high-impact sales copy or advertising to customers in the retail environment.

These and other objects and advantages of the present invention are addressed in the accompanying drawings, specification and claims.

SUMMARY OF THE INVENTION

The invention is directed to a container for the shipping and display of goods which comprises a box formed from a first blank, the box including a front panel having upper and lower flaps, a first side panel having upper and lower flaps, a second side panel having upper and lower flaps, and a rear panel having upper and lower flaps. The box further includes a breakaway panel formed within a portion of at least one of the front panel, the first side panel, the second side panel and the rear panel, with the breakaway panel being defined by a first line of weakness. The container further comprises a breakaway assist panel formed from a second blank distinct from the first blank, which breakaway assist panel includes a panel separation member. The breakaway assist panel is aligned with and adhered to the breakaway panel, such that removal of the breakaway panel from the box is effectuated by pulling on the panel separation member to rupture the first line of weakness defining the breakaway panel—towards simultaneously detaching the breakaway panel and the breakaway assist panel from the box, thereby facilitating the display of and access to goods contained within the container.

In a preferred embodiment, the breakaway panel is formed within a portion of at least one of the front panel, the front panel upper flap, and the front panel lower flap. In this embodiment, the breakaway assist panel further comprises a fold line defining a lower first portion and an upper second portion. The lower first portion of the breakaway assist panel is then adhered to at least a portion of the breakaway panel located in the front panel of the box. Likewise, the upper second portion of the breakaway assist panel is adhered to at least a portion of the breakaway panel located in at least one of the front panel upper flap and the front panel lower flap.

The breakaway assist panel may also include a top third portion, which is adhered to a portion of at least one of the front, first side, second side and rear panels not comprising the breakaway panel. In this embodiment, the breakaway assist panel may further include a second line of weakness serving to permit separation of the top third portion of the breakaway assist panel from the lower first and upper second portions of the breakaway assist panel. The breakaway assist panel separation member may comprise either a pull tab formed along an edge of the breakaway assist panel, or an aperture within the breakaway assist panel.

In another embodiment, the box and the breakaway assist panel are constructed from different materials. The breakaway assist panel may be constructed from a material suitable for the display of high-impact graphics, such as die cut chip board. Likewise, the box may be constructed from corrugated paperboard.

The invention is also directed to a method of forming a container for the shipping and display of goods, which comprises:

(1) forming a box from a first blank, the box including a front panel having upper and lower flaps, a first side panel having upper and lower flaps, a second side panel having upper and lower flaps, and a rear panel having upper and lower flaps;

(2) forming a breakaway panel within the box by creating a line of weakness within at least one of the front panel, the first side panel, the second side panel and the rear panel, with the line of weakness serving to define the breakaway panel;

(3) forming a breakaway assist panel from a second blank;

(4) aligning and adhering at least a portion of the breakaway assist panel to at least a portion of the breakaway panel;

(5) partially articulating the container to form a closed bottom surface;

(6) placing the goods within the container; and (7) closing and sealing the top surface of the container, in order to contain the goods within the container.

In an alternative embodiment of the invention, the method may include the identical steps (1)–(4) listed above, along with the following alternative steps:

(5) bringing the goods in direct contact with at least one of the front panel, the first side panel, the second side panel and the rear panel; and (6) articulating the container around the goods, and sealing each of the upper and lower flaps to form closed bottom and top surfaces, in order to contain the goods within the container.

In a further embodiment of these methods, the first blank for forming the box may comprise corrugated paperboard, and the second blank for forming the breakaway assist panel may comprise die cut chip board. Additionally, the breakaway assist panel may comprise a lower first portion and an upper second portion separated by a fold line, wherein the lower first portion of the breakaway assist panel is adhered to at least a portion of the breakaway panel located in the front panel, and the upper second portion of the breakaway assist panel is adhered to at least a portion of the breakaway panel located in at least one of the front panel upper flap and the front panel lower flap.

The above methods may also comprise the additional steps of pulling outwardly on the breakaway assist panel in order to rupture the line of weakness defining the breakaway panel, and then detaching the breakaway assist panel and the breakaway panel from the box, thereby facilitating the display of and access to the goods contained within the container.

DETAILED DESCRIPTION OF THE DRAWINGS

Figure 1:
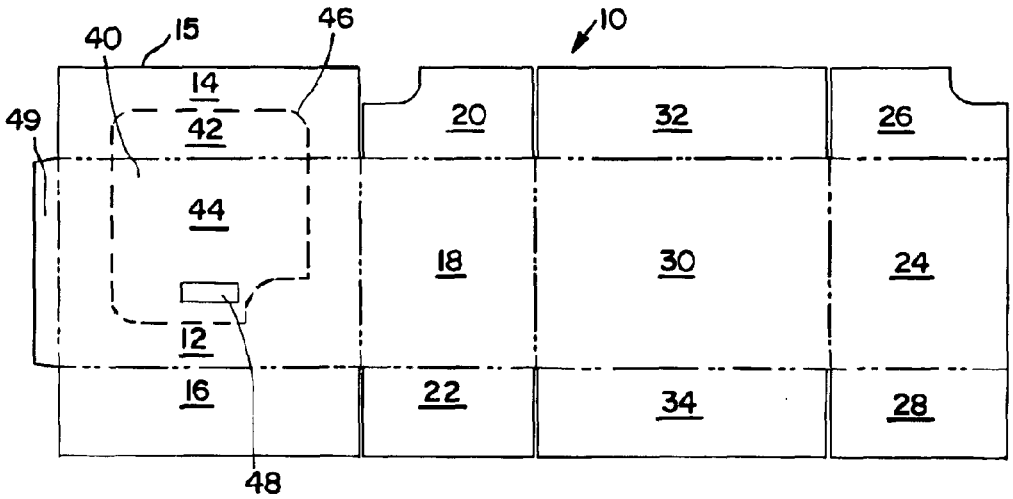
FIG. 1 is a top plan view of a blank for forming the box portion of the present invention.

While this invention is susceptible of embodiment in many different forms, there is shown in the drawings, and will be described in detail herein, one specific embodiment, with the understanding that the present embodiment is to be considered as an exemplification of the principles of the invention and is not intended to limit the invention to the embodiments illustrated.

Container 1 is shown generally in FIGS. 1 through 10 as comprising box portion 10 and breakaway assist panel 50. Box 10 comprises a known rectangular slotted carton (RSC) container, preferably formed from a single blank of corrugated material such as paperboard, although other materials may be used as desired. Box 10 is shown in FIG. 1 as a blank including front panel 12 having associated upper flap 14 and lower flap 16, first side panel 18 having associated upper flap 20 and lower flap 22, second side panel 24 having associated upper flap 26 and lower flap 28, and rear panel 30 having associated upper flap 32 and lower flap 34, and overlap panel 49. Each of the respective upper and lower flaps are joined to the associated panel by way of a conventional crush fold line.

Box 10 also includes line of weakness 46 associated with front panel 12 and upper flap 14, which serves to define breakaway panel 40. Breakaway panel 40 includes upper portion 42, lower portion 44 and aperture 48, which is sized so as to accept one or more fingers. Breakaway panel 40 is readily separable from the remainder of box portion 10 by means of line of weakness 46. Moreover, breakaway panel 40 is not limited to the particular shape and configuration shown herein, but may take any number of desired shapes or configurations. For example, breakaway panel 40 may be formed from a portion of only one surface of box 10. Alternatively, breakaway panel 40 may include portions of side panels 18 and 24 and/or rear panel 30, if so desired.

Figure 2:
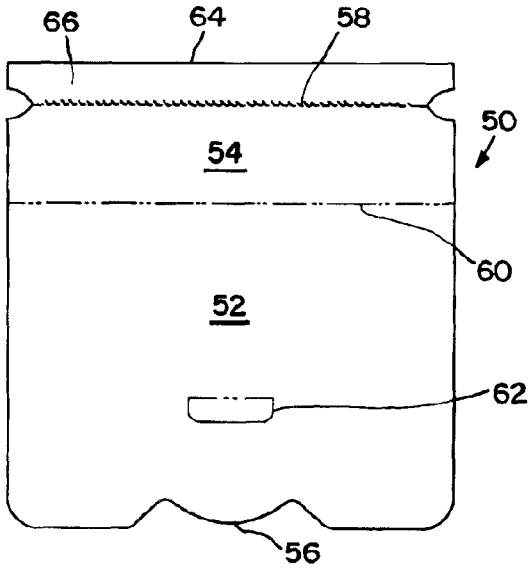
FIG. 2 is a top plan view of a blank for forming the breakaway assist panel of the present invention.

Breakaway assist panel 50, shown in FIG. 2, includes bottom portion 52, middle portion 54, top portion 66, tab member 56, line of weakness 58, fold line 60 and aperture 62. Bottom portion 52 and middle portion 54 of breakaway assist panel 50 are separated by means of fold line 60. Line of weakness 58 is preferably located near the top edge 64 of middle portion 54, and top portion 66 is defined by line of weakness 58 and top edge 64. Breakaway assist panel 50 is not limited to the particular shape and configuration shown herein, but rather may take any desired shape, corresponding to the shape of breakaway panel 40, such that breakaway assist panel 50 is adapted to cover substantially all of breakaway panel 40.

While breakaway assist panel 50 may be formed from a like material as box 10, such as corrugated paperboard, it may likewise be formed from a different material, such as die cut chip board, which is adapted for the display of high-impact graphics which are not as easily or inexpensively achieved with corrugated paperboard. For instance, the chip board panel 50 might include photographs showing the goods within the container or other subject matter which is designed to appeal to consumers, which type of display is more difficult to achieve via placement on a typical corrugated material. The use of such a material to form panel 50 is highly desirable for the manufacturer of the goods, in that it allows for unopened shipping containers to serve the further purpose of providing effective advertising, either for the goods contained therewithin, or even for other goods or services. As a result, the container becomes more attractive to merchants which regularly place unopened containers on their sales floors, such as warehouse club stores—for the purpose of generating additional sales through use of the unopened shipping containers as an effective display medium.

In order to form the blank for box 10, a rectangular piece of corrugated material of suitable size is first cut and formed using known methods for forming an RSC carton. Next, line of weakness 46 is cut into the blank, to form breakaway panel 40. Likewise, the blank for breakaway assist panel 50 is formed from a substantially rectangular piece of a desired material, preferably die-cut chip board. Line of weakness 58 is then cut into breakaway assist panel 50 near top edge 64, and fold line 60 is formed at the appropriate location.

Figure 3:
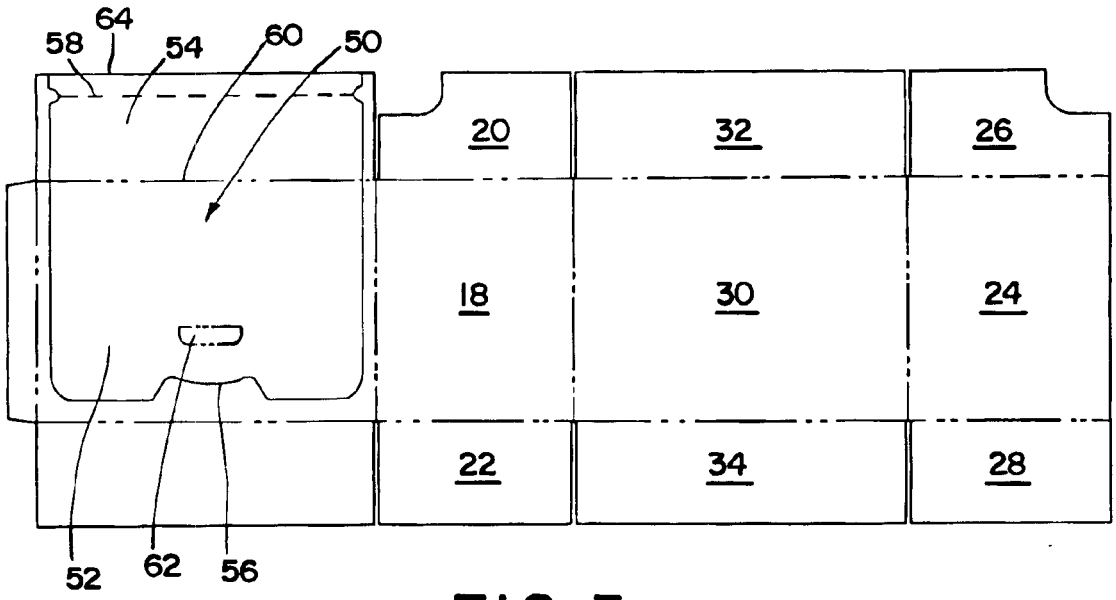
FIG. 3 is a top plan view of the blank of FIG. 1, after the breakaway assist panel blank of FIG. 2 has been affixed thereto.

Prior to articulation of box 10, breakaway assist panel 50 is adhered to breakaway panel 40 by means of a suitable adhesive, known to those of skill in the art, such that breakaway assist panel 50 covers substantially all of breakaway panel 40, and top edge 64 of breakaway assist panel 50 is aligned with top edge 15 of upper flap 14, as shown in FIG. 3. In this configuration, aperture 62 of breakaway assist panel 50 is aligned with aperture 48 of breakaway panel 40, to form a gripping surface to facilitate removal of breakaway panel 40 from box 10, as described below.

The desired adhesive is first applied to both upper portion 42 and lower portion 44 of breakaway panel 40, and to an area of upper flap 14 immediately adjacent top edge 15. Bottom portion 52 and middle portion 54 of breakaway assist panel 50 are then adhered to breakaway panel 40, while top portion 66 is adhered to upper flap 14. It is preferable to adhere top portion 66 to upper flap 14 in this fashion, so as to prevent accidental separation of breakaway panel 40 from box 10 during transit. If top portion 66 were not adhered to box 10, undesired separation of breakaway panel 40 from box 10 could occur due to forces exerted on top edge 64 of breakaway assist panel 50 by another object. For, example, if the bottom of an adjacent container were to catch top edge 64 during loading or unloading, the resultant force exerted on breakaway assist panel 50 could cause some or all of line of weakness 46 to rupture prematurely.

Figure 4:
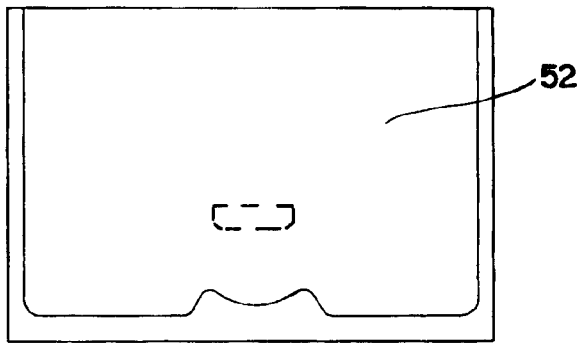
FIG. 4 is a front elevational view of a box formed from the blank of FIG. 1, after the breakaway assist panel has been affixed thereto and the container has been fully articulated.
Figure 5:
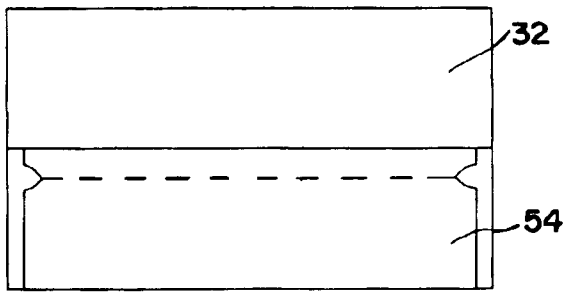
FIG. 5 is a top plan view of the box of FIG. 4.
Figure 6:
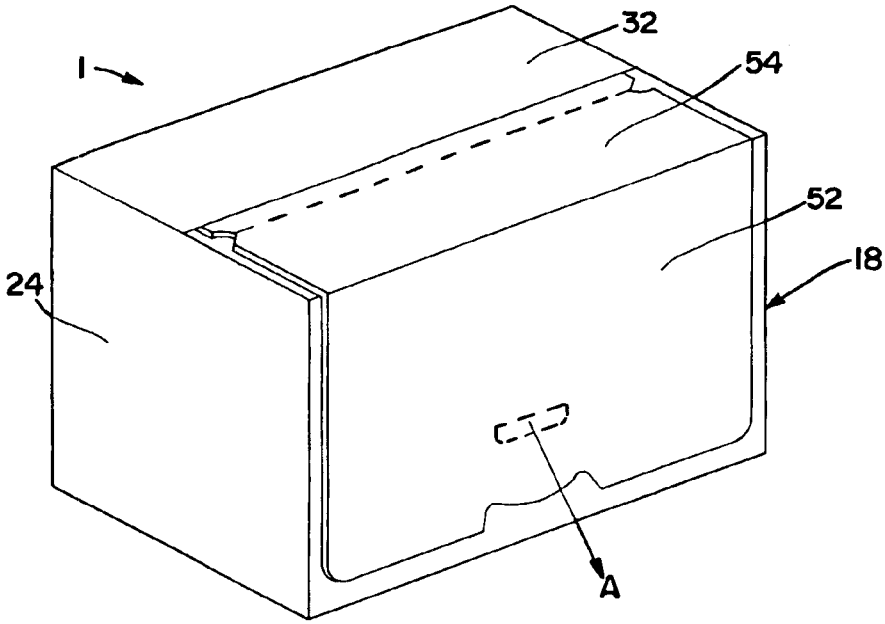
FIG. 6 is a top perspective view of the box portion of FIG. 4.

Container 1 is then articulated in the known manner for an RSC container. First, overlap panel 49 is secured to second side panel 24, preferably by means of a suitable adhesive. Next, lower flaps 16, 22, 28 and 34 are folded inward to form the bottom of the container, and are sealed by means of tape, adhesive, or other desired means. The container is then filled with product through the top opening. Finally, top flaps 14, 20, 26 and 32 are folded inward to form the top of the container, and are likewise sealed by means of tape, adhesive, or other desired means. Alternatively, the goods may first be brought into contact with one of panels 12, 18, 24 and 30, and the container then articulated about the goods. Fully assembled container 1 is shown in FIGS. 4–6.

Figure 7:
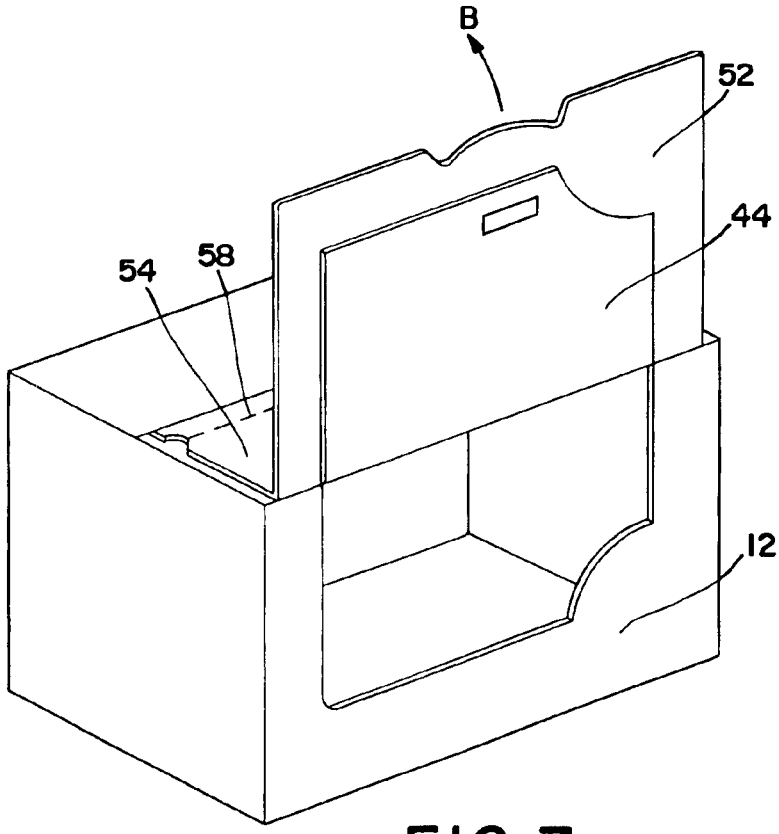
FIG. 7 is a top perspective view of the box of FIG. 4, after the breakaway panel has been partially separated from the box by means of the breakaway assist panel, but before the breakaway panel has been completely separated from the box.

The filled container 1 is then shipped to the vending location, typically a retail store, where the product is to be sold to the ultimate consumer. The vendor may convert container 1 to a display unit simply by removing breakaway panel 40 and breakaway assist panel 50. This is accomplished by first pulling outward on breakaway assist panel 50 in the direction of arrow A, in order to separate lower portion 44 of breakaway panel 40 from box 10 along line of weakness 46. The force needed to separate breakaway panel 40 from box 10 may be exerted on breakaway assist panel 50 by way of either pull tab 56 or aperture 62. FIG. 7 shows container 1 after lower portion 44 of breakaway panel 40 has been separated from box 10, while upper portion 42 remains attached to box 10.

Figure 8:
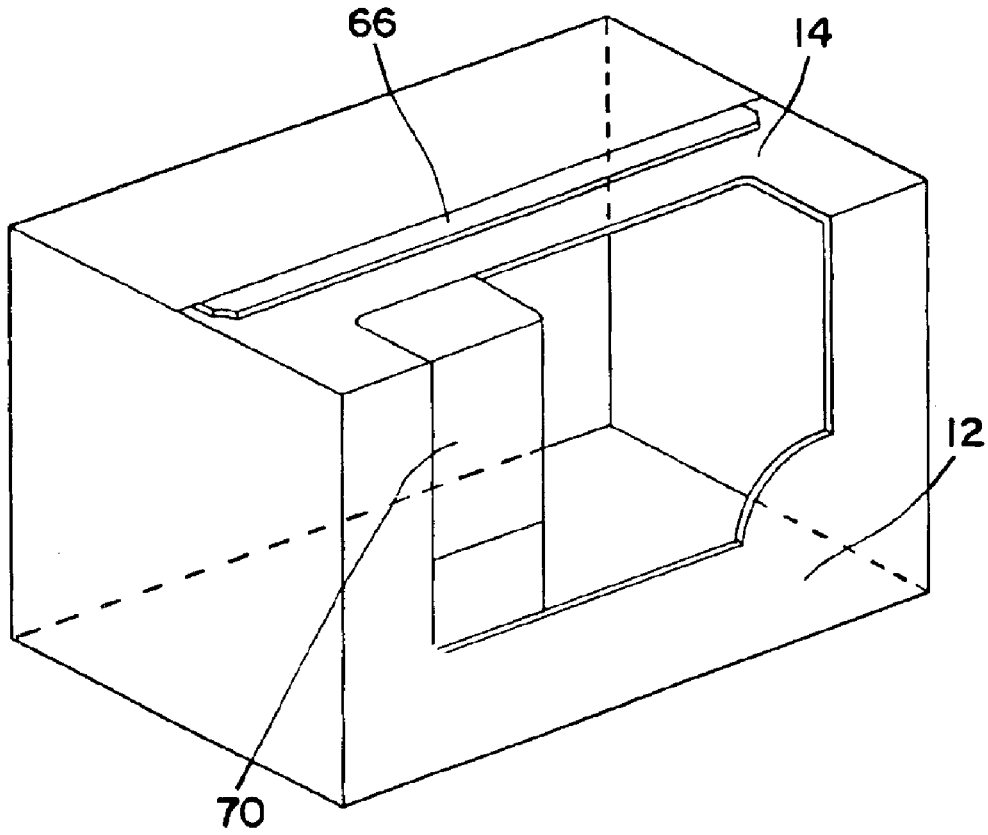
FIG. 8 is a top perspective view of the box of FIG. 4, after the breakaway assist panel and breakaway panel have been completely separated from the box, permitting display of and access to the contents therewithin.

Breakaway panel 40 can then be completely removed from box 10 by continuing to pull in the direction of arrow B, to separate upper portion 42 from box 10 along line of weakness 46. Finally, bottom and middle portions 52 and 54 of breakaway assist panel 50 are separated from top portion 66 along line of weakness 58. FIG. 8 shows container 1 after breakaway panel 40 and breakaway assist panel 50 have been completely removed from box 10. Because breakaway assist panel 50 is adhered only to breakaway panel 40, the remaining portions of box 10 are not damaged by the removal of breakaway panel 40, either structurally or aesthetically. As a result, box 10 is well suited to be used as a display container for goods 70 contained therein, after breakaway panel 40 has been removed. Once the removal process is completed, breakaway panel 40 and breakaway assist panel 50 may then simply be discarded. Notably, all of these benefits are achieved without contiguously integrating breakaway assist panel 50 into the overall blank structure of FIG. 1.

The foregoing description and drawings merely explain and illustrate the invention, and the invention is not limited thereto except insofar as the pending claims are so limited, as those skilled in the art and having the present disclosure before them will be able to make modifications and variations therein without departing from the scope of the invention.

What is claimed is:

1. A container for the shipping and display of goods, said container comprising:

a box formed from a first blank, said box including a front panel having upper and lower flaps, a first side panel having upper and lower flaps, a second side panel having upper and lower flaps, and a rear panel having upper and lower flaps;

said box including a breakaway panel formed within a portion of at least two adjoining ones of said front panel, said front panel upper flap, said front panel lower flap, said first side panel, said second side panel, said rear panel, said rear panel upper flap and said rear panel lower flap, said breakaway panel being defined by a continuous first line of weakness;

a breakaway assist panel formed from a second blank distinct from said first blank, said breakaway assist panel including a panel separation member; and said breakaway assist panel being aligned with and adhered to said breakaway panel, such that removal of said breakaway panel from said box is effectuated by pulling on the panel separation member to rupture said continuous first line of weakness in said breakaway panel, towards detaching the entirety of said breakaway panel from said box, thereby facilitating the display of and access to the goods contained within said container.

2. The container of claim 1, wherein said breakaway panel is formed within a portion of both said front panel and at least one of said front panel upper flap, said front panel lower flap, said first side panel and said second side panel.

3. The container of claim 2, wherein said breakaway assist panel further comprises a fold line defining a lower first portion and an upper second portion.

4. The container of claim 3, wherein said lower first portion of said breakaway assist panel is adhered to at least a portion of said breakaway panel located in said front panel.

5. The container of claim 3, wherein said upper second portion of said breakaway assist panel is adhered to at least a portion of said breakaway panel located in at least one of said front panel upper flap and said front panel lower flap.

6. The container of claim 1, wherein said breakaway assist panel further comprises a bottom portion and a top portion, said top portion being adhered to a portion of at least one of said front, first side, second side and rear panels not included within said breakaway panel.

7. The container of claim 6, wherein said breakaway assist panel further includes a second line of weakness serving to permit separation of said top portion of said breakaway assist panel from said bottom portion of said breakaway assist panel.

8. The container of claim 1, wherein said breakaway assist panel separation member comprises a pull tab formed along an edge of said breakaway assist panel.

9. The container of claim 1, wherein said breakaway assist panel separation member comprises an aperture within said breakaway assist panel.

10. The container of claim 1, wherein said box and said breakaway assist panel are constructed from different materials.

11. The container of claim 10, wherein said breakaway assist panel is constructed from a material suitable for the display of high-impact graphics.

12. The container of claim 11, wherein said breakaway assist panel is constructed from die cut chip board.

13. The container of claim 10, wherein said box is constructed from corrugated paperboard.

14. The container of claim 1, wherein said first blank and said second blank are each constructed of a paperboard material.

15. The container of claim 1, wherein said at least two adjoining ones of said front panel, said front panel upper flap, said front panel lower flap, said first side panel, said second side panel, and said rear panel, said rear panel upper flap and said rear panel lower flap are substantially orthogonal to one another.

* * * * *